US006188171B1

(12) United States Patent
Hamm

(10) Patent No.: US 6,188,171 B1
(45) Date of Patent: Feb. 13, 2001

(54) CATHODE-RAY TUBE CONTACT SPRING

(76) Inventor: Kelly Eugene Hamm, 130 Old Holtwood Rd., Holtwood, PA (US) 17532

( * ) Notice: Under 35 U.S.C. 154(b), the term of this patent shall be extended for 0 days.

(21) Appl. No.: 09/333,641

(22) Filed: Jun. 15, 1999

(51) Int. Cl.[7] ..... H01J 29/06
(52) U.S. Cl. ..... 313/407; 313/402
(58) Field of Search ..... 513/407, 402, 513/479, 482

(56) References Cited

U.S. PATENT DOCUMENTS

| | | | | |
|---|---|---|---|---|
| 4,310,779 | | 1/1982 | Penird et al. | 313/407 |
| 4,433,267 | | 2/1984 | Kuryla et al. | 313/402 |
| 4,670,686 | | 6/1987 | Muenkel et al. | 313/402 |
| 5,126,624 | * | 6/1992 | Ji | 313/402 |
| 5,561,341 | * | 10/1996 | Won | 313/407 X |
| 6,037,709 | * | 3/2000 | Nagakawa et al. | 313/407 |

* cited by examiner

*Primary Examiner*—Ashok Patel
(74) *Attorney, Agent, or Firm*—Joseph S. Tripoli; Dennis H. Irlbeck

(57) ABSTRACT

A cathode-ray tube has an internal magnetic shield and at least one contact spring attached to the shield. The shield includes a land with an outer edge and an inner edge. The spring includes two portions, an improved clasp portion attached to the shield at the land, and a contact leaf portion. The improved clasp portion includes a flat body with a reverse bend hook at a first end, and a latch and a catch at an end opposite to the first end. The hook engages the outer edge of the land, and the latch engages the inner edge of the land. The catch includes a bent end portion that forms an acute angle with the remainder of the catch. The bent end portion is positioned to engage the inner edge of the land if the spring is rotated about the hook. The leaf portion is connected to and extends from the latch.

3 Claims, 5 Drawing Sheets

CATHODE-RAY TUBE CONTACT SPRING

This invention relates to a cathode-ray tube having an internal magnetic shield with at least one contact spring attached thereto.

BACKGROUND OF THE INVENTION

A color cathode-ray tube (CRT) typically has an internal magnetic shield located within a funnel thereof to reduce the influence of magnetic fields on electron beam trajectories. The shield is usually made of cold-rolled steel and fastened to a shadow mask frame. A flexible contact spring sometimes is attached to the shield or frame to make electrical contact with a conductive coating on the inner surface of the tube funnel. An early method of attaching a contact spring was by welding.

However, the welding method often resulted in undesirable loose particles in the tube.

There have been several improvements suggested to overcome the problem associated with welding contact springs to either a frame or an internal magnetic shield. For example, U.S. Pat. No. 4,310,779, issued to Penird et al., on Jan. 12, 1982, and U.S. Pat. No. 4,433,267, issued to Kuryla et al., on Feb. 21, 1984, disclose contact springs that include a wrap-around clip that snaps onto a flute formed at the rear end of a magnetic shield. U.S. Pat. No. 5,126,624, issued to Ji, on Jun. 30, 1992, discloses a contact spring that includes a triangular type head that fits within a hole in a shadow mask frame. U.S. Pat. No. 4,670,686, issued to Muenkel et al., on Jun. 2, 1987, discloses a spring with a leaf tab and stiffening structure that is inserted through two opposed slots in an internal magnetic shield. Each of the foregoing contact springs includes one or more disadvantages. The simpler ones may work loose or move around too much, and the more complex ones are costly to manufacture. Therefore, there is a need for a contact spring with a simple design, which will be easy to insert and will not move around.

An improved contact spring is disclosed in U.S. patent application Ser. No. 09/149,320, filed on Sep. 8, 1998, by A. W. Bucher now allowed. The Bucher application claims a contact spring that includes a clasp with a hook and latch that can be snapped onto a land of and internal shield. It has been found that there are conditions that may even cause the contact spring of Bucher to disengage from an internal shield. The present invention provides an improvement in the type of contact spring shown in the Bucher application that prevents such disengagement.

SUMMARY OF THE INVENTION

A cathode-ray tube has an internal magnetic shield and at least one contact spring attached to the shield. The shield includes a land with an outer edge and an inner edge. The spring includes two portions, an improved clasp portion attached to the shield at the land, and a contact leaf portion. The improved clasp portion includes a flat body with a reverse bend hook at a first end, and a latch and a catch at an end opposite to the first end. The hook engages the outer edge of the land, and the latch engages the inner edge of the land. The catch includes a bent end portion that forms an acute angle with the remainder of the catch. The bent end portion is positioned to engage the inner edge of the land if the spring is rotated about the hook. The leaf portion is connected to and extends from the latch.

DETAILED DESCRIPTION OF THE PREFERRED EMBODIMENT

Figure 1:
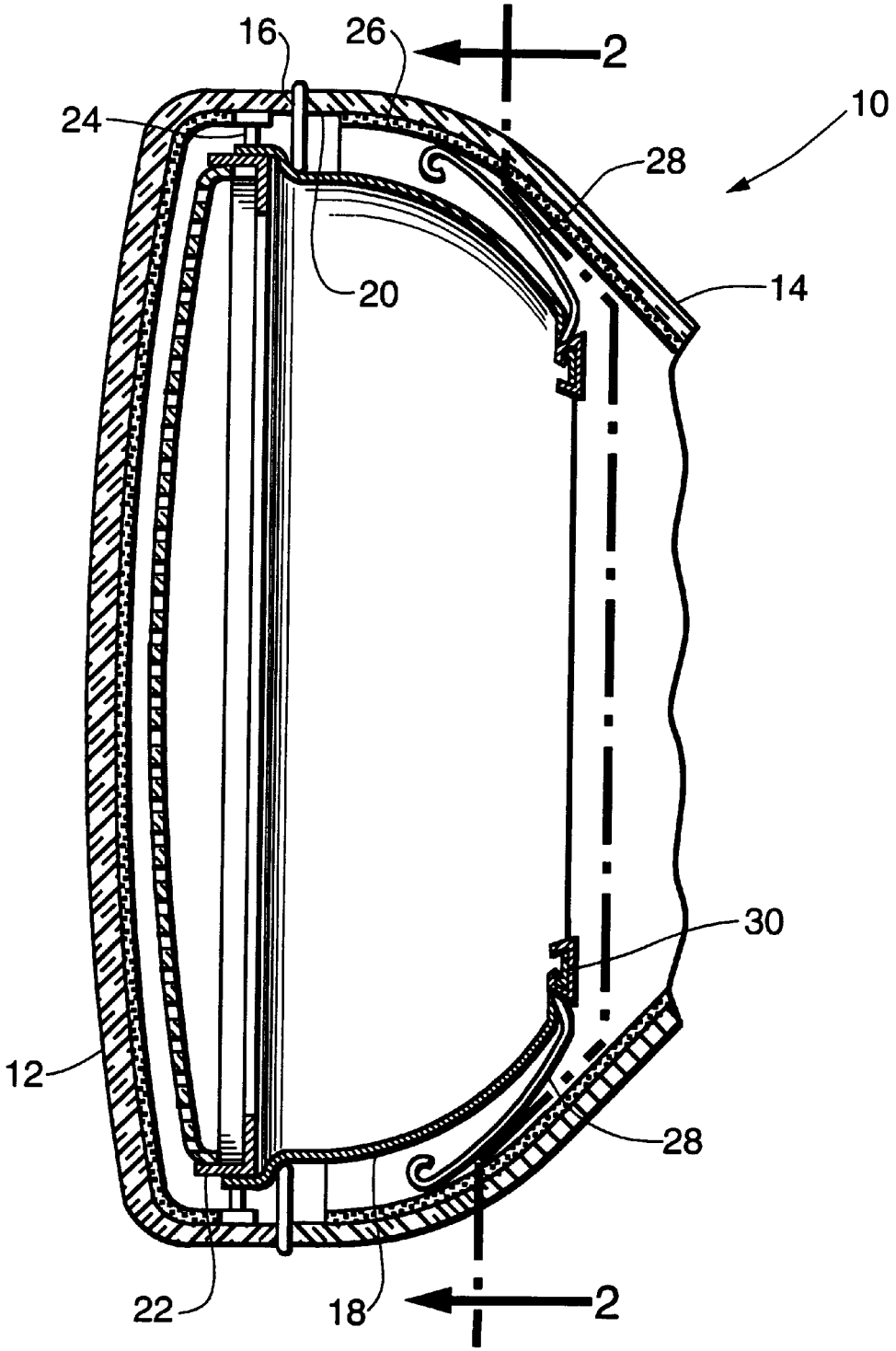
FIG. 1 is a cross-sectional view of the front portion of a cathode-ray tube illustrating a pair of contact springs attached to an internal magnetic shield within the tube.
Figure 2:
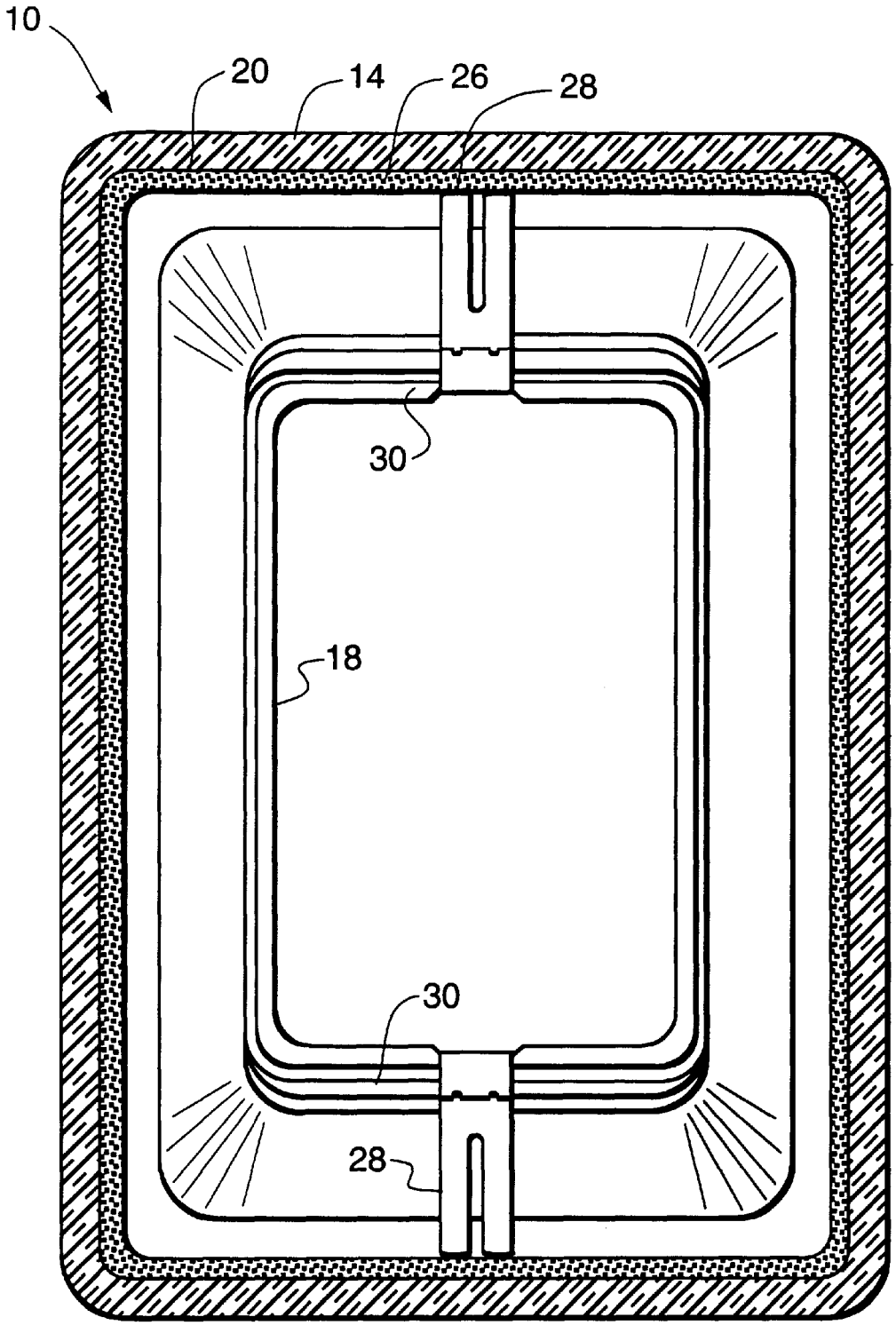
FIG. 2 is a cross-sectional view taken along line 2—2 of FIG. 1.

FIGS. 1 and 2 show a cathode-ray tube 10 having a faceplate panel 12 sealed to a funnel 14 thereof along an edge 16 of the panel 12. The tube 10 has an internal magnetic shield 18 disposed therein proximate an inner surface of the funnel 14. The magnetic shield 18 is fastened to a shadow mask frame 22, which is supported by mounting studs 24 that extend inwardly from the faceplate panel 12. The inner surface 20 of the funnel 14 has a conductive coating 26 thereon extending along the surface 20 to a predetermined distance from the edge 16. This conductive coating 26 comprises a graphite coating which serves as the positive anode for the tube. A pair of contact springs 28 are attached at the rear portion 30 of the internal magnetic shield 18 for effecting an electrical connection between the shield 18 and the conductive coating 26.

Figure 3:
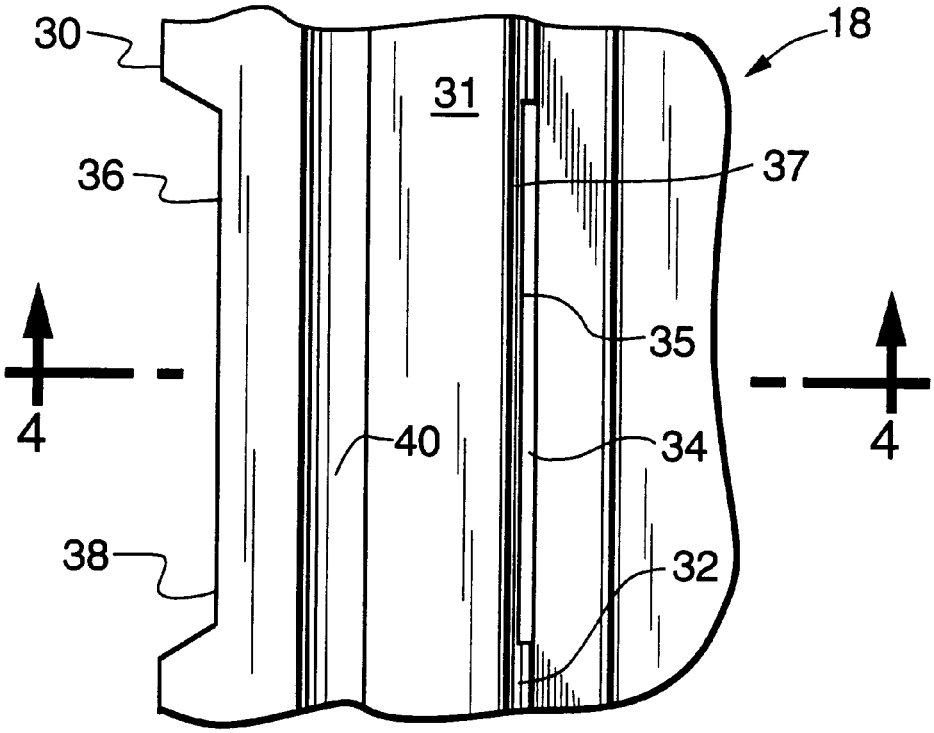
FIG. 3 is a plan view of a portion of the internal magnetic shield of FIG. 1, at a spring location.
Figure 4:
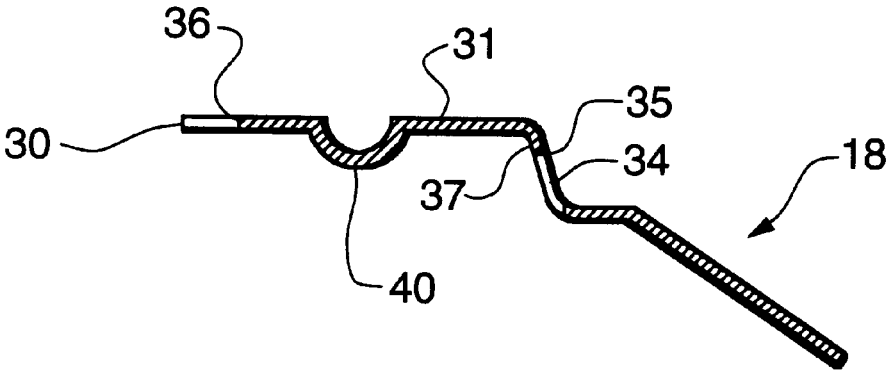
FIG. 4 is a cross-sectional view taken along line 4—4 of FIG. 3.

FIGS. 3 and 4 show a part of the rear portion 30 of the internal magnetic shield 18 that is at a spring location. The part of the rear portion 30 has a land 31 that is raised from the continuation of the shield contour by a step riser 32. At the spring location, the step riser 32 includes an elongated aperture 34 therein. A small portion of the step riser 32 forms an angled lip 37 on the land 31. The distal end of the lip 37 forms an inner edge 35 of the land 31, opposite an outer edge 36 of the land 31. The outer edge 36 of the land 31 includes a notch 38 at the spring location, and the land 31 also includes a reinforcing bead 40 that parallels the inner and outer edges of the land 31.

Figure 5:
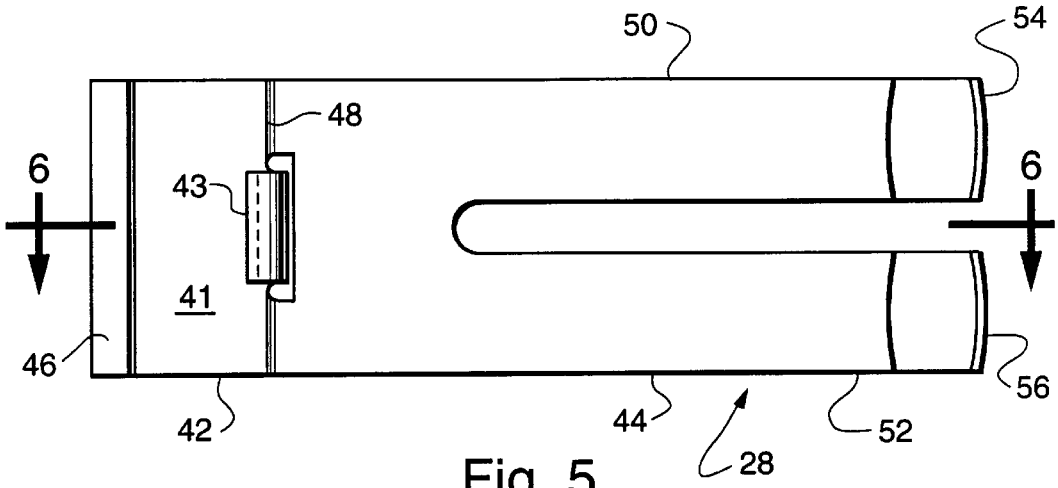
FIG. 5 is a bottom view of a contact spring of FIG. 1.
Figure 6:
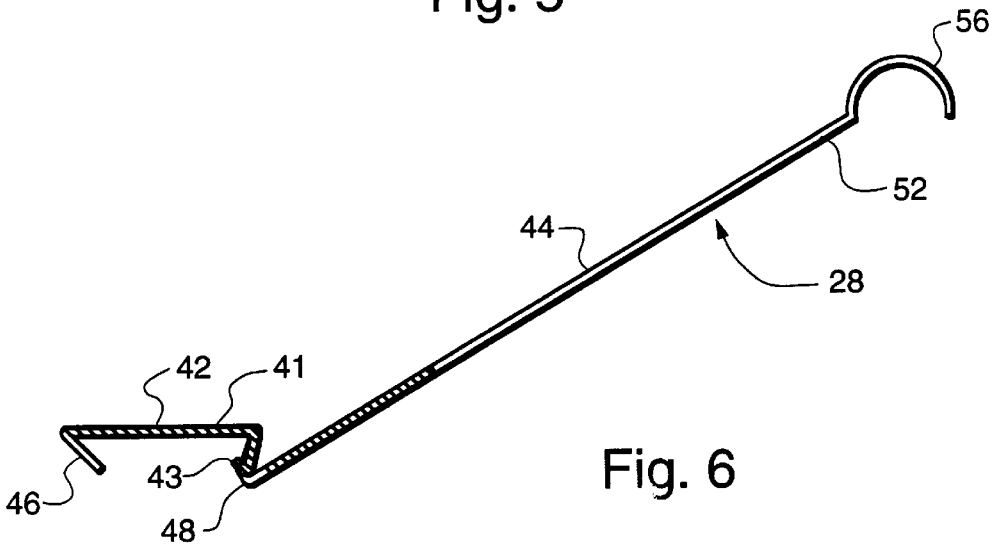
FIG. 6 is a cross-sectional view taken along line 6—6 of FIG. 5.

FIGS. 5 and 6 show the contact spring 28 having two portions, a clasp 42 and a contact leaf 44. The clasp 42 provides for attachment of the contact spring 28 to the internal magnetic shield 18, and the contact leaf 44 is cantilevered from the clasp portion 42 to provide contact to the internal conductive coating 26 on the inner surface of the tube. The clasp 42 includes a flat body 41 separating a reverse bend hook 46, forming an acute angle with the body 41, and a latch 48 and catch 43 at the proximal end of the clasp 42. The leaf 44 extends from the latch 48 and includes two separated parallel arms, 50 and 52, each arm having round contact surfaces 54 and 56, respectively, at the distal ends thereof.

Figure 7:
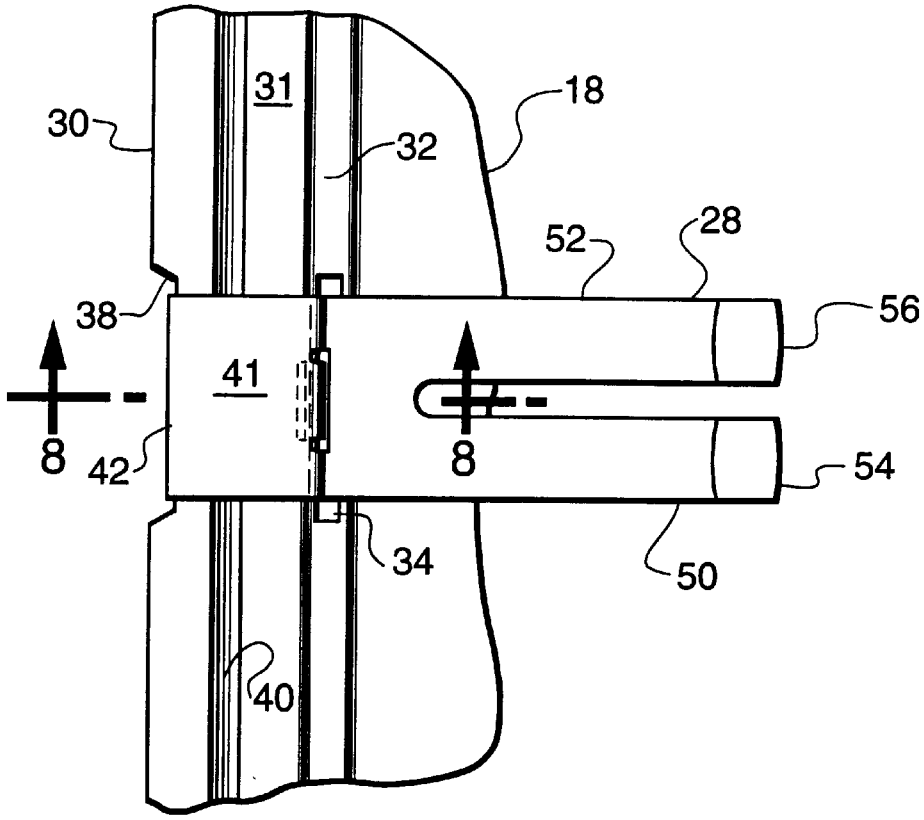
FIG. 7 is a plan view of a portion of the internal magnetic shield with a contact spring attached thereto.
Figure 8:
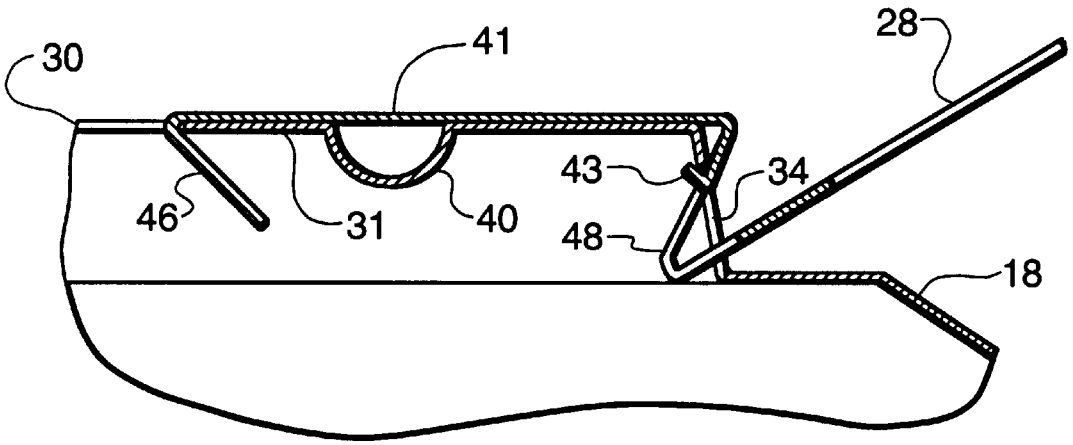
FIG. 8 is a cross-sectional view taken along line 8—8 of FIG. 7.

FIGS. 7 and 8 show the contact spring 28 connected to the internal magnetic shield 18. The hook 46 engages the outer edge of the land 31 of the shield 18 at the notch 38, and the latch 48 engages the inner edge 35 of the land 31 of the shield 18 at the aperture 34. The catch 43 is a safety device to prevent disengagement of the spring 28 from the land 31, when an excessive force is applied to the contact leaf 44 causing the spring 28 to rotate about the hook 46. Such a force can be applied accidentally during handling of the magnetic shield 18. The catch 43 accomplishes this safety function by hooking onto or catching the angled lip 37 of the land 31, when the contact leaf 44 of the spring 28 rotates away from the magnetic shield. During installation of the spring 28, the hook 46 is positioned first against the land 31 and serves as a pivot for rotating the spring, so that the latch 48 enters the aperture 34 and engages the inner edge 35 of the land 31 of the shield 18. At this point, the catch 43 passes around the land 31, where it is positioned to catch the land, if the spring 28 is rotated.

The interaction of the contact spring clasp portion 42 with the rear portion 30 of the shield provides a self-tightening feature when the contact leaf portion 44 contacts the conductive coating 26 on the inner wall of the funnel 14. As the contact leaf portions 44 of both springs contact the inside of the funnel, they deflect toward the shield 18 and cause the latches 48 to further close around the inner and outer edges, 35 and 36, respectively, of the shield lands.

The contact spring of the present invention is simpler in design and easier to install than most previous contact springs. Furthermore, the present contact spring eliminates the scraping between parts that occurs during the installation of many prior contact springs.

What is claimed is:

1. In a cathode-ray tube having an internal magnetic shield and at least one contact spring attached to said shield, said shield including a land with an outer edge and an inner edge, said spring including two portions, a clasp portion attached to the shield at said land, and a contact leaf portion, the improvement comprising said clasp portion including a flat body with a reverse bend hook at a first end, and a latch and a catch at an end opposite to the first end, said hook engaging the outer edge of said land, said latch engaging the inner edge of said land, said catch including a bent end portion that forms an acute angle with the remainder of said catch, said bent end portion is positioned to engage said inner edge of said land when said spring is rotated about said hook, and said leaf portion is connected to and extends from said latch.

2. The tube as defined in claim 1, wherein said latch includes two outer portions and said catch is spaced and separated from said latch and is positioned between the two outer portions of said latch.

3. The tube as defined in claim 1, wherein said contact leaf portion is connected to and extends from said latch, and a distal end of said leaf portion contacts an interior surface of said tube.

* * * * *